US006276141B1

(12) United States Patent
Pelletier

(10) Patent No.: US 6,276,141 B1
(45) **Date of Patent: *Aug. 21, 2001**

(54) INTERNALLY HEATSHIELDED NOZZLE

(75) Inventor: Robert R. Pelletier, Chardon, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/439,637

(22) Filed: Nov. 12, 1999

Related U.S. Application Data

(63) Continuation of application No. 09/031,871, filed as application No. PCT/US97/03964 on Mar. 13, 1997, now Pat. No. 6,076,356.

(60) Provisional application No. 60/013,351, filed on Mar. 13, 1996.

(51) Int. Cl.[7] ..... F02C 1/00

(52) U.S. Cl. ..... 60/740; 60/39.32

(58) Field of Search ..... 60/39.32, 740

(56) References Cited

U.S. PATENT DOCUMENTS

| | | |
|---|---|---|
| 1,908,066 | 5/1933 | Sedlmeir . |
| 2,548,904 | 4/1951 | Neal et al. . |
| 3,159,971 | 12/1964 | Moebius et al. . |
| 3,662,959 | 5/1972 | Sample, Jr. . |
| 4,070,826 | 1/1978 | Stenger et al. . |
| 4,258,544 | 3/1981 | Gebhart et al. . |
| 4,409,791 | 10/1983 | Jourdain et al. . |
| 4,491,272 | 1/1985 | Bradley et al. . |
| 4,735,044 | 4/1988 | Richey et al. . |
| 5,105,621 | 4/1992 | Simmons et al. . |
| 5,269,468 | 12/1993 | Adiutori . |
| 5,423,178 | 6/1995 | Mains . |
| 5,579,645 | 12/1996 | Prociw et al. . |
| 5,598,696 | 2/1997 | Stotts . |
| 5,701,732 | 12/1997 | Nesbitt et al. . |
| 5,988,531 | 11/1999 | Maden et al. . |
| 6,003,781 | 12/1999 | Kwan . |
| 6,149,075 | 11/2000 | Moertle et al. . |

FOREIGN PATENT DOCUMENTS

| | | |
|---|---|---|
| 2 230 333 A | 5/1990 | (GB) . |
| WO 80/00593 | 4/1980 | (WO) . |

OTHER PUBLICATIONS

Literature for Deltatwist Heat Exchange Products, copyright date 1984.

Four (4) drawings representative of prior art heatshield designs. It is respectfully requested that the U.S. Patent Office initially consider these drawings as showing heatshield designs which were publicly known or used in the United States prior to Applicant's invention. These designs are generally described in the Specification, pp. 1–4. Applicant reserves the right to supplement this information Disclosure Statement should additional information become available.

International Application Published Under PCT Application No. WO 97/34108.

Notification of Transmittal of The International Preliminary Examination Report filed in PCT/US97/03964.

*Primary Examiner*—Charles G. Freay
*Assistant Examiner*—Ehud Gartenberg
(74) *Attorney, Agent, or Firm*—Christopher H. Hunter

(57) ABSTRACT

A fuel injector for a gas turbine engine of an aircraft has an inlet fitting, a fuel nozzle, and a housing stem fluidly interconnecting and supporting the nozzle on the fitting. An internal heatshield assembly comprising an internal fuel conduit extends in a bore in the housing stem. An upper end of the fuel conduit has a rigid, fluid-tight connection with a fuel inlet passage in the fitting, while the lower end of the fuel conduit has a rigid, fluid-tight connection with the fuel nozzle. The bore closely surrounds the fuel conduit and a stagnant air gap is provided between the internal walls of the bore and the outer surface of the fuel conduit. The fuel conduit has a coiled portion to allow for thermal expansion.

26 Claims, 5 Drawing Sheets

INTERNALLY HEATSHIELDED NOZZLE

CROSS REFERENCE TO RELATED APPLICATION

This application is continuation of U.S. Ser. No. 09/031,871, filed Feb. 27, 1998, now U.S. Pat. No. 6,076,356, which is a continuation-in part of International Application No. PCT/US97/03964 filed on Mar. 13, 1997, which designated the United States and which claims priority of U.S. Provisional No. 60/013,351, filed Mar. 13, 1996.

FIELD OF THE INVENTION

The present invention relates generally to fuel injectors for gas turbine engines of aircraft, and more particularly to heatshield structures for the fuel injectors.

BACKGROUND OF THE INVENTION

Fuel injectors for gas turbine engines on an aircraft direct fuel from a manifold to a combustion chamber. The fuel injector typically has an inlet fitting connected to the manifold for receiving the fuel, a fuel spray nozzle located within the combustion chamber of the engine for receiving the fuel, a fuel spray nozzle located within the combustion chamber of the engine for atomizing (dispensing) the fuel, and a housing stem extending between and fluidly interconnecting the inlet fitting and the fuel nozzle. Appropriate check valves and/or flow dividers can be disposed within the fuel nozzle to control the flow of fuel through the nozzle. The fuel injector has an attachment flange which enables multiple injectors to be attached to the combustor casing of the engine in a spaced-apart manner around the combustor to dispense fuel in a generally cylindrical pattern.

Fuel injectors are typically heatshielded because of the high operating temperatures within the engine casing. High temperature gas turbine compressor discharge air flows around the housing stem of the fuel injector before entering the combustor. The heat shielding prevents the fuel passing through the injector from breaking down into its constituent components (i.e., "coking"), which occurs when the wetted wall temperatures of a fuel passage exceed 400° F. The coke in the fuel passages of the fuel injector can build up to restrict fuel flow to the nozzle.

One type of heatshield assembly for a fuel injector has an internal heatshield disposed within the fuel passage of the housing stem. The internal heatshield comprises a straight fuel conduit which is rigidly attached at one end to either the fuel nozzle or the inlet fitting, and is left unattached at the other end to allow for differences in thermal expansion between the relatively cooler inner heatshield and the hotter outer housing stem. The unattached end has a small clearance within the bore of the stem which allows for fuel to enter the cavity between the heatshield and the internal walls of the housing stem. Over time, the fuel in this cavity cokes to provide an insulating layer between the housing stem and the fuel conduit. While this technique for heatshielding is appropriate for some applications, the insulating coke layer can take a number of engine cycles to form, and the resulting coke layer can migrate into the fuel stream, which can affect downstream fuel passages.

Another type of heatshield assembly for a fuel injector has an external heatshield around the housing stem. This heatshield typically includes a pair of outer U-shaped heatshield members which are located on opposite sides of the housing stem, and extend axially herealong. The heatshield members are secured together along their opposite abutting side edges, and to the housing stem, such as by welding or brazing. The heatshield members define a stagnant air gap between the heatshield members and the outer surface of the housing stem. It is believed that the stagnant air gap between the heatshield members provides better insulating characteristics than a coke or carbon-filled gap. While this type of heatshield assembly can also be appropriate in certain applications, the use of external heatshield members increases the number of components for the fuel injector, which thereby increases material costs, assembly time, and hence the overall cost of the fuel injector. There can also be issues with the attachment of the heatshield members to the housing stem because of the thermal expansion characteristics of the outer heatshield members. This can limit the useful life of the fuel injectors over constant engine cycling.

It is known to provide an internal heatshield comprising a straight fuel conduit with both ends of the conduit sealed to the housing stem. In this case, a stagnant air gap is created between the conduit and the internal walls of the housing stem. To compensate for the thermal expansion characteristics of the heatshield and the housing stem, it is known that at least one end of the conduit can include a metal bellows or a slip-fit attachment with one or more O-ring seals to allow for thermal expansion of the conduit with respect to the housing stem. The other end of the conduit is typically rigidly attached to the housing stem. It is believed that both ends have not been rigidly attached to the housing stem in the past because of concerns of early fatigue failures over repeated engine cycling due to the thermal expansion characteristics of the conduit. While the stagnant air gap provides better insulating characteristics than a coke or carbon-filled gap, it is believed that a leak path can develop over time around the O-rings, particularly at elevated temperatures. Using O-rings and metal bellows can also increase the number of components associated with the fuel injector, and can be complicated and time-consuming to assemble, thereby also increasing the over-all cost of the fuel injector.

Thus it is believed there is a demand in the industry for a further improved fuel injector for gas turbine engines which maintains fuel passage wetted wall temperatures within the housing stem below the coking threshold, which has few components which are relatively straight-forward to manufacture and assemble, and which maintains reliable, leak-free operation over multiple cycles of the aircraft engine.

SUMMARY OF THE INVENTION

The present invention provides a novel and unique fuel injector for a gas turbine engine of an aircraft, and more particularly, a novel and unique heatshield structure for the fuel injector.

According to the principles of the present invention, the fuel injector has an inlet fitting for receiving fuel, a fuel nozzle for dispensing fuel, and a housing stem fluidly interconnecting and supporting the fuel nozzle on the fitting. An internal heatshield assembly comprising an internal fuel conduit extends within a bore formed in the housing stem. An upper end of the fuel conduit has a rigid, fluid-tight connection with a fuel inlet passage in the fitting, while the lower end of the fuel conduit has a rigid, fluid-tight connection with the nozzle. The internal walls of the bore closely surround the fuel conduit and provide a stagnant air gap between the bore and the outer surface of the fuel conduit. To allow for thermal expansion of the fuel conduit, the fuel conduit has a coiled or otherwise convoluted portion within an enlarged cavity in the bore. The coiled portion of the fuel conduit is preferably at a location in the fuel injector which is exterior to the engine casing when the fuel injector is mounted to the engine. The bore can be completely enclosed with a vacuum drawn in the bore, or can be open at its lower end to the prefilmer and the air swirler in the fuel nozzle. The fuel injector can be easily assembled with the engine combustor by a flange extending outwardly from the housing stem, and easily disassembled for inspection or replacement.

The internal coiled fuel conduit can include only a single fuel flow passage from the fuel inlet to the nozzle, or alternatively, can include a pair of fuel flow passages from the inlet to the nozzle. In the latter case, a pair of concentric fuel tubes are provided, each of which has a rigid fluid-tight connection at an upper end with the inlet fitting to receive fuel from one or more fuel inlet passages in the fitting, and a rigid, fluid-tight connection at the lower end with the nozzle to provide the fuel to fuel discharge passages in the nozzle. The tubes are evenly spaced apart along the length of the fuel conduit.

The present invention thereby provides an improved fuel injector which has a heatshield assembly which maintains the fuel passage wetted wall temperatures at a minimum, has relatively few components which are straight-forward to assemble and manufacture, and provides-reliable, leak-free operation over repeated engine cycling.

Other features and advantages of the present invention will become further apparent upon reviewing the following specification and attached drawings.

DETAILED DESCRIPTION OF THE PREFERRED EMBODIMENT

Figure 1:
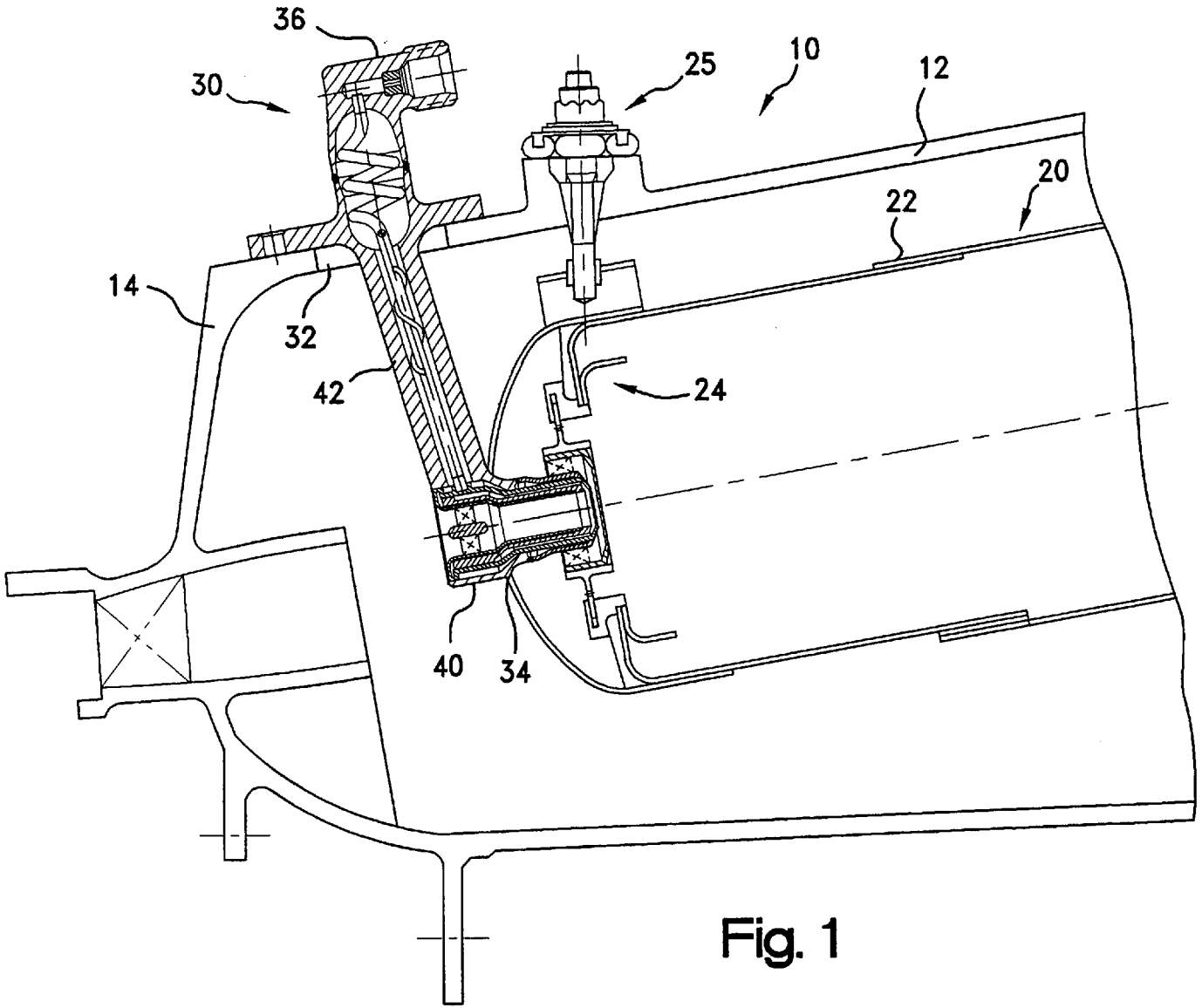
FIG. 1 is a perspective view of portions of a gas turbine engine illustrating a fuel injector constructed according to the principles of the present invention.

Referring to the drawings, and initially to FIG. 1, a gas turbine engine for an aircraft is illustrated generally at 10. The gas turbine engine 10 includes an outer casing 12 extending forwardly of an air diffuser 14. The casing and diffuser enclose a combustor, indicated generally at 20, for containment of the burning fuel. The combustor 20 includes a liner 22 and a combustor dome, indicated generally at 24. An igniter, indicated generally at 25, is mounted to casing 12 and extends inwardly into the combustor for igniting fuel. The above components are conventional in the art and their manufacture and fabrication are well known.

A fuel injector, indicated generally at 30, is received within an aperture 32 formed in the engine casing and extends inwardly through an aperture 34 in the combustor liner. Fuel injector 30 includes a fitting 36 disposed exterior of the engine casing for receiving fuel, a fuel nozzle 40 disposed within the combustor for dispensing fuel, and a housing stem 42 interconnecting and structurally supporting nozzle 40 with respect to fitting 36.

Figures 2, 3:
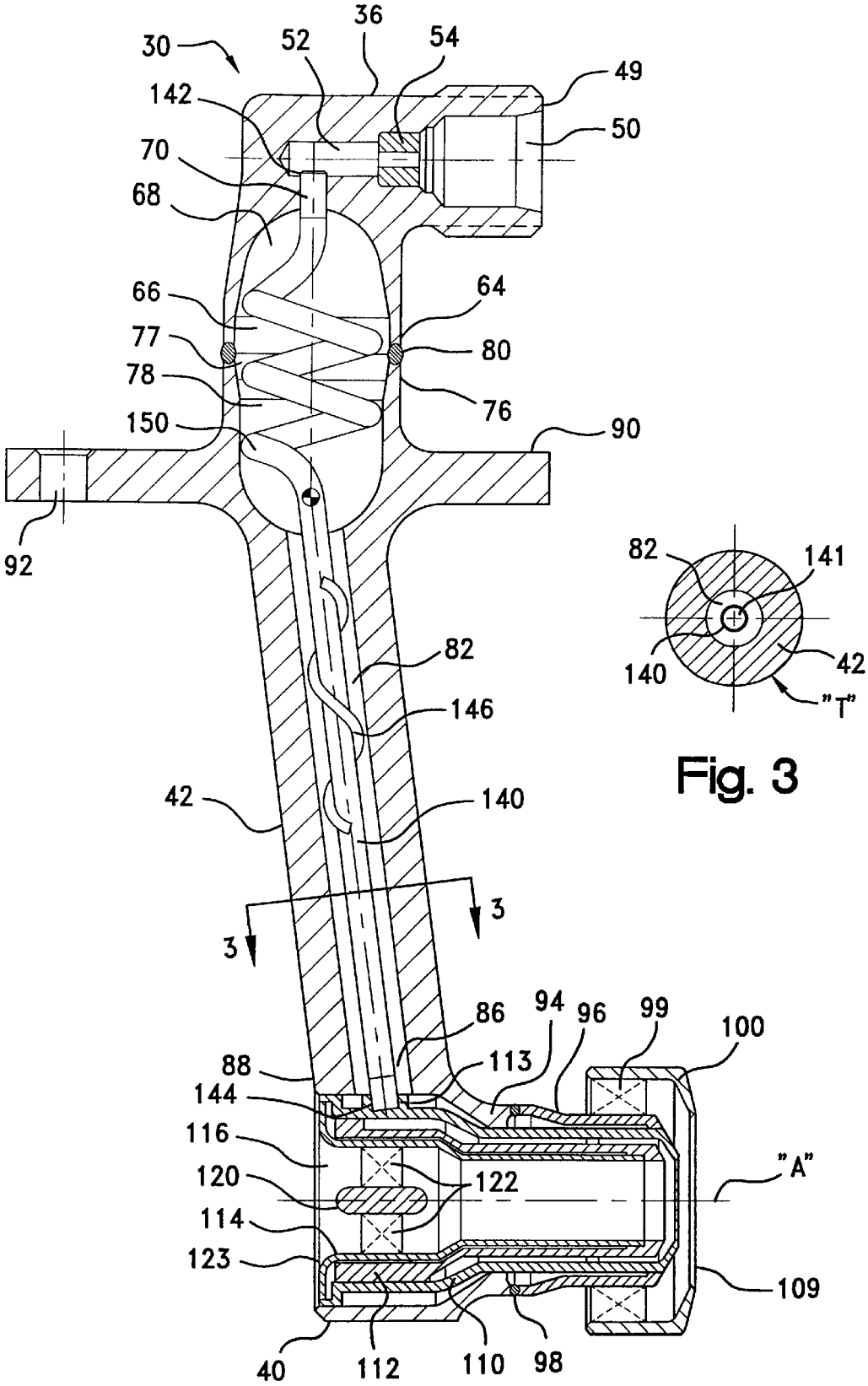
FIG. 2 is a cross-sectional side view of the fuel injector of FIG. 1.
FIG. 3 is a cross-sectional top view of the fuel injector taken substantially along the plane described by the lines 3—3 of FIG. 2.

Referring now to FIG. 2, the fitting 36 for the fuel injector preferably includes an inlet end 49 with an inlet opening 50. Inlet opening 50 has external threads to receive a corresponding inwardly-threaded conduit (not shown) to the fuel manifold of the engine. Inlet opening 50 extends centrally through the fitting 36 to fuel passage 52. A restrictor/trim orifice 54 is disposed in an enlarged portion of the fluid passage 52 for controlling fuel flow through the fitting. The restrictor/trim orifice is brazed to the fitting which fixedly locates and secures the restrictor/trim orifice in the fitting. Fitting 36 further includes an outlet end 64 with an annular outlet opening 66. Outlet opening 66 has an enlarged recess 68 opening outwardly from the outlet end 64. Recess 68 is fluidly connected to fluid passage 52 through a short fluid passage 70. Fitting 36 is preferably formed from appropriate heat-resistant and corrosion-resistant material as is known in the art, such material preferably being Hast X metal. The passages and cavity in the fitting are preferably formed using common manufacturing techniques, such as die-casting and drilling.

Housing stem 42 includes an inlet end 76 with annular inlet opening 77. Inlet opening 77 also includes an enlarged recess 78 opening outwardly from the inlet end. The inlet end of housing stem 42 is attached to the outlet end 64 of fitting 36 in a conventional manner, such as by welding at 80, to provide a fluid-tight seal. When attached, recess 68 in fitting 36 and recess 78 in housing stem 42 together define a cavity, the function of which will be described below.

Housing stem 42 includes a central, longitudinally-extending bore 82 extending from the recess 78 at the inlet end of the housing stem to an outlet opening 86 at the outlet end 88 of the housing stem. Housing stem 42 has a radial thickness sufficient to support nozzle 40 in the combustor when the injector is mounted to the engine. Preferably, housing stem 42 has a radial thickness "T" (FIG. 3) of at least 2.75 millimeters, however, this can vary depending on the particular application. Housing stem 42 is also formed from appropriate heat-resistant and corrosion resistant material as should be known to those skilled in the art, which material is preferably Hast X. The housing stem is also preferably formed using common manufacturing techniques, such as die-casting and drilling.

An annular flange 90 is formed in one piece with the housing stem 42 proximate the upper end 76, and extends radially outward therefrom. Flange 90 includes apertures 92 extending therethrough to allow the flange to be easily and securely connected to, and disconnected from, the casing of the engine using, e.g., bolts or rivets. As shown in FIG. 1, flange 90 has a flat lower surface which is disposed against the flat outer surface of the casing.

The lower end 88 of housing stem 42 is formed integrally with fuel nozzle 40, and preferably in one piece with at least a portion of the nozzle. For example, the outlet end 88 of the housing stem includes an annular outer shroud 94 circumscribing the longitudinal axis "A" of the nozzle 40. Outer shroud 94 is connected at its downstream end to an outer air swirler 96, such as by welding at 98. Outer air swirler 96 includes radially-outward projecting swirler vanes 99 and an outer annular shroud 100. Air swirler 96 is tapered inwardly at its downstream end to direct air in a swirling manner toward the central axis A at the discharge end 109 of the nozzle. An inner annular prefilmer 110 and an annular fuel swirler 112 are disposed radially inwardly from outer shroud 94, and together define an annular fuel passage through the nozzle. Prefilmer 110 has a fuel inlet opening 113 at its upstream end, the reason for which will be described below. Prefilmer 110 and fuel swirler 112 are also tapered inwardly at their downstream end to direct fuel in a swirling manner toward the central axis A at the discharge end of the nozzle.

Finally, an inner heatshield 114 is disposed radially inward from the fuel swirler. The inner heatshield extends centrally within the nozzle to protect the fuel in the fuel passage through the nozzle from elevated temperatures. The inner heatshield defines a central air passage 116 extending axially through the nozzle. An air swirler 120 with radially-extending swirler blades 122 is disposed in the air passage proximate the air inlet end 123 of the nozzle. Air swirler 120 directs air in a swirling manner along the central axis A of the nozzle to the discharge end 109.

The nozzle described above is formed from an appropriate heat-resistant and corrosion resistant material which should be known to those skilled in the art. Preferably, the nozzle is formed from Hast-X metal. The nozzle is also formed using typical manufacturing techniques, which should also be known to those skilled in the art. However, while a preferred form of the nozzle has been described above, it should be apparent to those skilled in the art that other nozzle designs could also be used with the present invention. The invention is not limited to any particular nozzle design, but rather is appropriate for a wide variety of commercially-available nozzles.

An important aspect of the invention is the inner heat-shield assembly in housing stem 42 which protects fuel flowing from fitting 36 to fuel nozzle 40, and prevents the fuel from coking. To this end, a fuel conduit 140 fluidly interconnects fitting 36 with nozzle 40. Fuel conduit 140 has a hollow central passage 141 (FIG. 3) for the passage of fuel. The thickness and outer diameter of the fuel conduit can of course vary depending upon the particular application, however, it is preferred that the fuel conduit have a thickness of 0.5 millimeters and an outer diameter of 4.0 millimeters. Fuel conduit 140 extends from a first connection end 142 tightly received within passage 70 in fitting 36, to a second end connection 144 tightly received within opening 113 in prefilmer 110. The ends of the fuel conduit can be fluidly sealed and rigidly and permanently attached within the respective openings in an appropriate manner, for example, welding or brazing. Fuel conduit 140 extends centrally within cavity 66 of fitting 36, through cavity 78 in housing stem 42, through bore 82, and into opening 86.

Preferably, fuel conduit 140 is closely surrounded by the internal walls of the housing stem. By the term "closely surrounded" it is meant that a small gap is provided between the exterior surface of the fuel conduit and the internal walls of the bore. The gap should be small enough to minimize the overall size of the fuel conduit, yet large enough such that stagnant air in the gap provides appropriate thermal protection for the fuel in the fuel conduit. The size of the gap can vary depending upon the particular application, however it is preferred that the interior walls of the housing stem are spaced radially apart from the outer surface of the fuel conduit by about 1.0 millimeters. The air gap is provided along substantially the entire length of the fluid conduit, except where the fuel conduit connects to the fitting and to the fuel nozzle. Fuel is prevented from flowing through the stagnant air gap by virtue of the first fluid-tight connection 142 and second fluid-tight connection 144. The fuel conduit 104 is also formed from appropriate heat-resistant and corrosion-resistant material, for example 300 series stainless steel.

It is noted that the outlet opening 86 to the bore 82 in the housing stem has a fluid path to the first air swirler 96 in the fuel nozzle. This fluid path is provided through the clearance gaps between the prefilmer 110 and the outer shroud 94, and between the prefilmer 110 and the air swirler 96. In this manner, should a fuel leak develop along the fuel conduit which flows into the air gap, the fuel will be discharged through the discharge end of the nozzle. However, it is also anticipated that the downstream end of the bore surrounding the fuel conduit can be closed, that is, fluidly sealed such as by welding the opening 86. A vacuum can be provided within the bore during the welding operation. Such a vacuum in the bore would further increase the thermal protection capabilities of the present invention.

To centrally locate and maintain a spaced-apart distance between fluid conduit 140 and the internal walls of housing stem 42, a spacer wire, indicated generally at 146 extends in a helical fashion along at least a portion of the fluid conduit 140. The spacer wire has a diameter which is appropriate for the particular application, and is preferably also formed from appropriate heat-resistant and corrosion-resistant material, for example Hast-X or stainless steel.

To allow fluid conduit 140 to thermally expand and contract within the fuel injector, fuel conduit 140 includes a coiled or convoluted portion 150 toward the upstream end of the conduit. The coiled portion is received within the cavity formed by recess 66 of fitting 36 and the recess 78 of housing stem 42. The coiled portion is also spaced apart from the internal walls of the cavity such that a stagnant air gap is provided around the coils. Preferably the coiled portion 150 is upstream from flange 90 such that when the fuel injector is assembled with the engine casing, the coiled portion 150 is located exterior to the combustor, and preferably exterior to the engine casing. While the number of turns of the coil can vary depending upon the particular application (temperature range, material composition of fuel conduit and housing stem, etc.), it is preferred that at least one and one-half turns are provided in the coil such that the fuel conduit can thermally expand without significant stress being applied to the upper connection 142 or the lower connection 144 during repeated engine cycling. The coiled portion of the fuel conduit can be formed in any conventional manner, such as by locating the fuel conduit around a mandrel.

Figure 4:
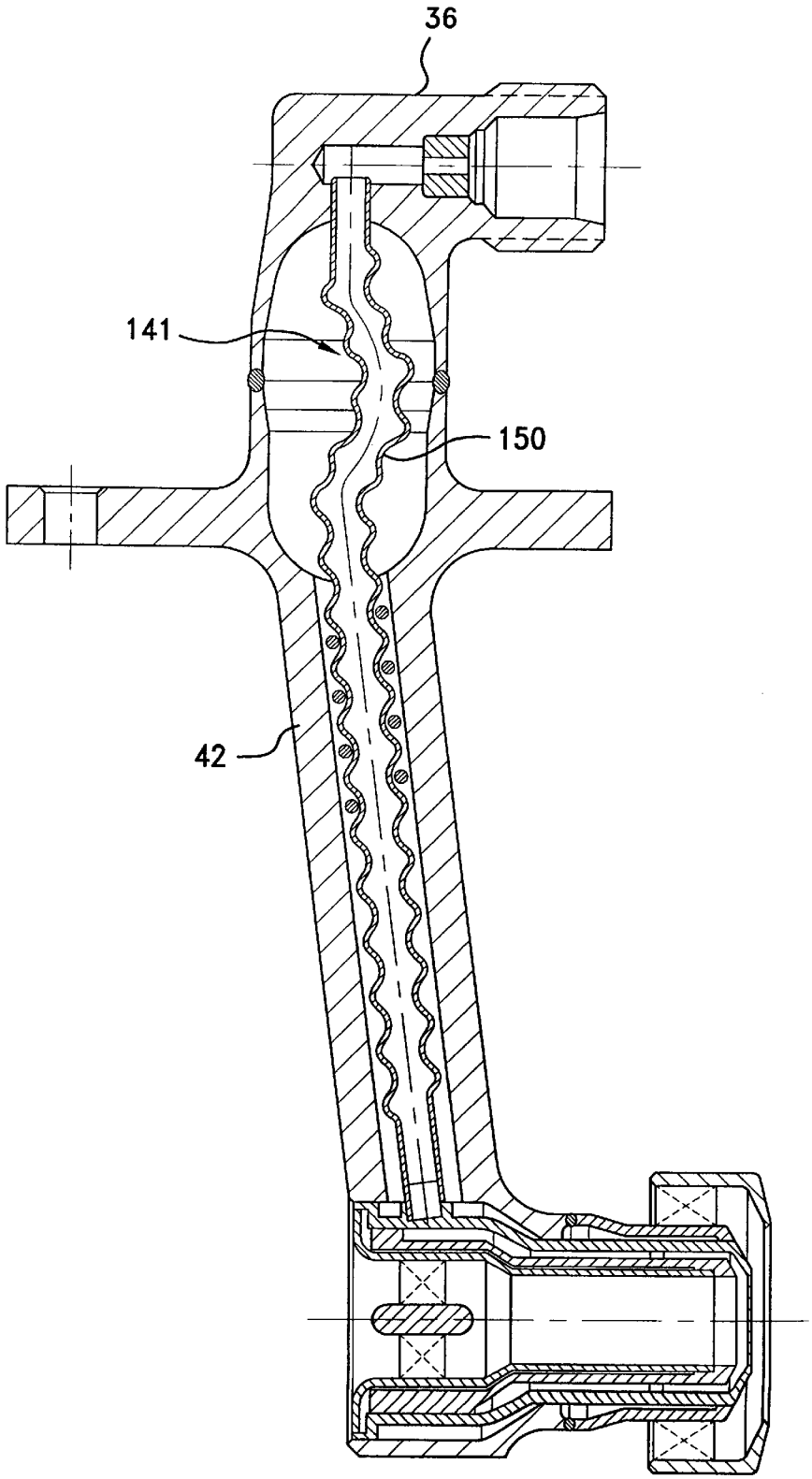
FIG. 4 is a cross-sectional side view of a fuel injector as in FIG. 1 showing an additional aspect of a fuel conduit for the injector.

Referring now to FIG. 4, another fuel conduit 140 is shown with a convoluted portion, indicated generally at 141. Convoluted portion 141 is again, preferably located within the cavity formed between housing stem 42 and fitting 36. The convoluted portion allows the fuel conduit to thermally expand without causing stress on the connection points.

As also shown in FIG. 4, the fuel conduit can have a twisted or fluted shape, with undulations or spirals along the length of the conduit. Such a fuel conduit is commercially-available from a number of sources, for example from Delta Limited of Tulsa, Okla., under the mark/designation Deltatwist.

It is also believed possible, with appropriate fuel conduit composition or construction (for example a twisted fuel conduit as described above), that the conduit could extend directly between the connection with the fitting to the connection with the nozzle without such a convoluted (or coiled) portion. Such a fuel conduit would again allow thermal expansion without causing stress on the connection points during thermal cycling by virtue of the structure of the conduit. Such a conduit would also be connected in a rigid, permanent, fluid-tight manner to the fitting and nozzle as described above, and would have a stagnant air gap surrounding the conduit to provide thermal protection.

In any case, referring again to FIGS. 1–3, in assembling the fuel injector, fuel conduit 140 is initially brazed to fitting 36 at first connection 142. The fuel conduit 140 is then inserted into bore 82 of housing stem 42, with the downstream end of fuel conduit 140 being received within the opening 113 in prefilmer 110 and brazed thereto. The air swirler 96 is then welded to the outer shroud 94 of the housing stem. The outlet end 64 of fitting 36 is then welded to the inlet end 77 of housing stem 42. The assembled fuel injector can then be inserted through the opening 32 in the engine casing (see FIG. 1), with the nozzle being received within the opening 34 in the combustor. The flange 80 on the fuel injector can then be secured to the engine casing in the above-described manner, such as by bolts or rivets. It is noted that the housing stem provides the sole and primary support for the nozzle in the combustor. The nozzle is not otherwise attached to the combustor to allow for simple and rapid removal of the fuel injector from the engine casing.

Figure 5:
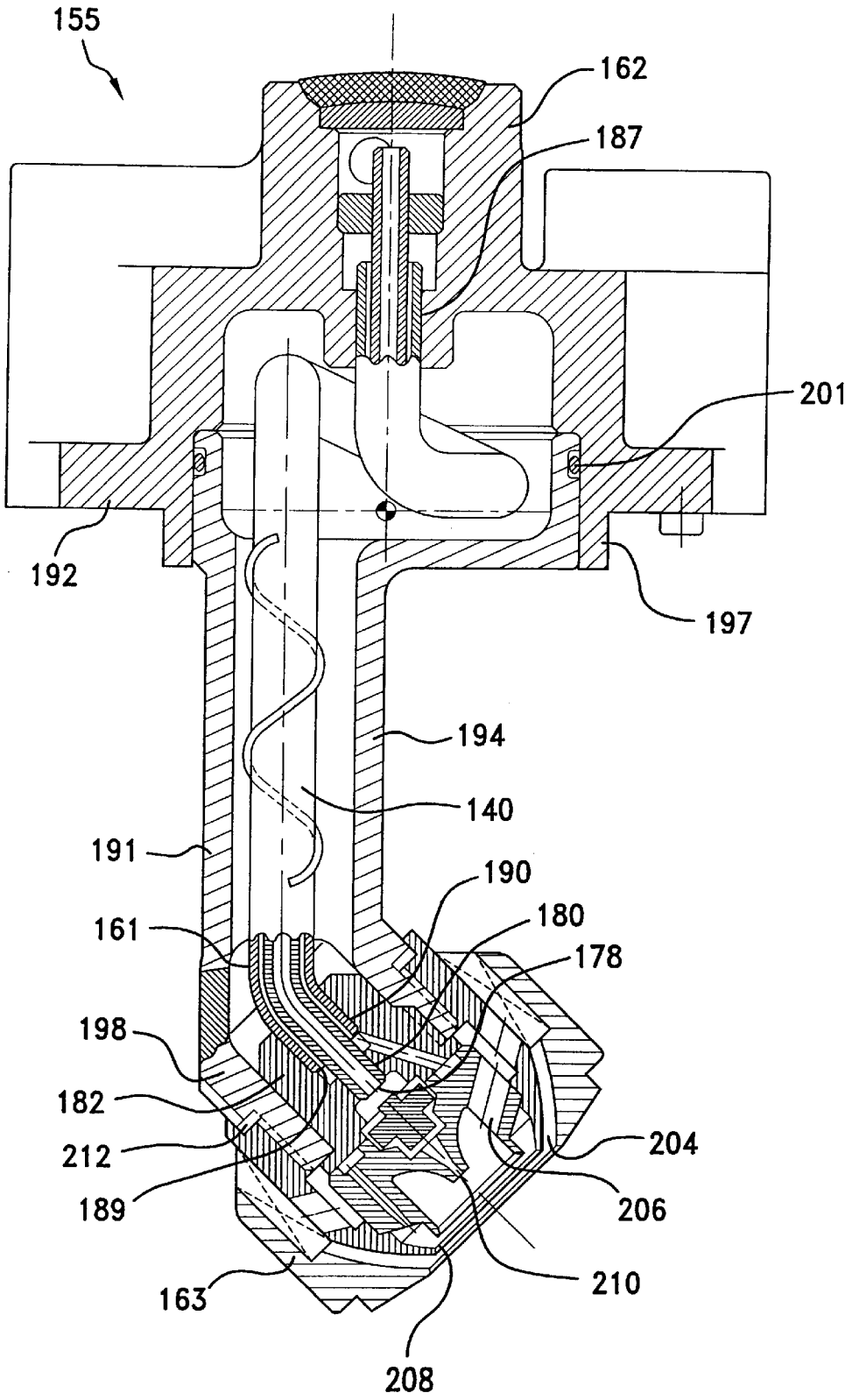
FIG. 5 is a cross-sectional side view of a fuel injector similar to FIG. 1, but showing an additional aspect of the present invention where a pair of concentric fuel tubes are provided.
Figure 6:
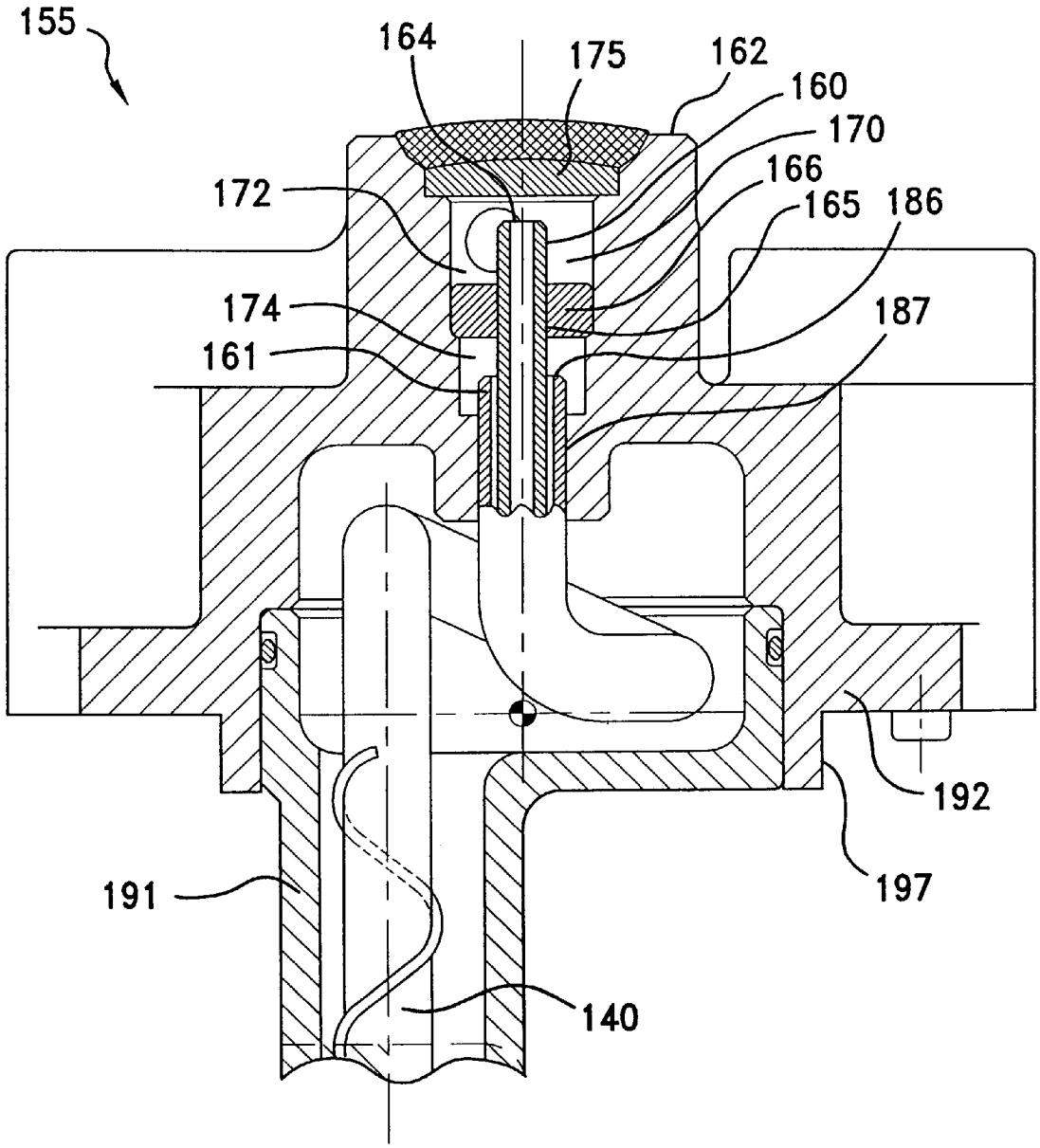
FIG. 6 is an enlarged cross-sectional side view of a portion of the fuel injector of FIG. 5.

While the fuel conduit 140 illustrated in FIGS. 1–3 is described as having a single bore which provides a single fuel flow passage from the inlet fitting to the nozzle, it is also possible that the fuel conduit could provide multiple fuel flow passages. For example, as illustrated in FIGS. 5 and 6, the fuel conduit 140 for fuel injector 155 is shown as having an inner fuel tube 160 concentric with an outer fuel tube 161 for fluidly connecting housing 162 with nozzle tip 163. The inner and outer fuel tubes are preferably formed from appropriate heat-resistant and corrosion resistant material, for example 300 series stainless steel.

Inner fuel tube 160 has a first connection end 164 tightly received (i.e., fluidly sealed and rigidly and permanently attached such as by welding or brazing) within a passage 165 in retainer 166. The retainer 166 is fixed (e.g., welded or brazed) within a bore 170 in housing 162 and fluidly separates a first fuel chamber 172 from a second fuel chamber 174. Bore 170 can be formed in housing 162 by, e.g., drilling, and has an open end which is closed by an end cap 175 welded or otherwise attached to the housing. Inner fuel tube 160 opens into first fuel chamber 172. First fuel chamber 172 is fluidly connected (by e.g., a fitting similar to fitting 36 in FIG. 2) to the fuel manifold of the engine to receive a supply of fuel. Inner fuel tube 160 also includes a second connection end 178 tightly received (i.e., fluidly sealed and rigidly and permanently attached such as by welding or brazing) within a passage 180 in tip adapter 182. Inner fuel tube 160 thereby directs fuel from the first chamber 172 to tip adapter 182 and then to nozzle tip 163 for dispensing by the nozzle.

Outer fuel tube 161 also has a first connection end 186 tightly received (i.e., fluidly sealed and rigidly and permanently attached such as by welding or brazing) within a passage 187 in housing 162. Outer fuel tube 161 opens into second fuel chamber 174. Second fuel chamber 174 is also fluidly connected (by e.g., a fitting) to the fuel manifold of the engine to receive a supply of fuel. Outer fuel tube 161 also includes a second connection end 189 tightly received (i.e., fluidly sealed and rigidly and permanently attached such as by brazing or welding) within a passage 190 in tip adapter 182. The passage 190 in tip adapter 182 for outer fuel tube 161 is preferably concentric with, and radially larger than, the passage 180 for inner fuel tube 160. The outer fuel tube 161 directs fuel received from the second fuel chamber 174 to tip adapter 182 and then to nozzle tip 163 for dispensing by the nozzle.

The outer fuel tube 161 is preferably equally spaced from the inner fuel tube 160 along the length of fuel conduit 140. The amount of spacing can vary depending upon the particular application and flow volumes necessary through the first and second fuel tubes. A spacer wire (not shown) can be located between the inner fuel tube and the outer fuel tube if necessary or desirable to maintain their spaced relation. Generally any dimensional changes affecting the fluid conduit 140 caused during cycling of the engine will be applied to the inner and outer fuel tubes equally so that these tubes will remain spaced-apart during engine operation and significant stresses will not be created therebetween. Further, by using dual fuel tubes providing two fuel passages in the fuel conduit, operational advantages in the nozzle can be achieved while using essentially the same space as a single-passage fuel conduit.

The remainder of the structure of the fuel injector 155 illustrated in FIGS. 5 and 6 can be the same as the injector 30 illustrated in FIGS. 1–3, that is, the internal walls of the housing stem 191 can closely surround the fuel conduit 140, and the injector can be mounted to the engine casing by flange 192. The housing stem 191 fits within housing 162 and is fixed (e.g., welded or brazed) to the internal walls of the lower portion 197 of the housing 162.

The fuel injector 155 can have essentially the same nozzle structure as described above with respect to the air blast nozzle 40 of FIGS. 1–3, with the exception that an additional fuel path provided through the nozzle head to the discharge end of the nozzle. Alternatively, the fuel injector can have the atomizing nozzle structure of FIG. 5, with an outer air swirler 204 surrounding the nozzle 205, an inner air swirler 206, an outer fuel discharge orifice 208 between the inner and outer air swirlers and fluidly connected to outer fuel tube 161 of fuel conduit 140, and an inner fuel discharge orifice 210 within the inner air swirler 206 and fluidly connected to the inner fuel tube 160 of fuel conduit 140.

In any case, the fuel conduit 140 in FIGS. 5 and 6 is surrounded by a stagnant air gap defined between fuel conduit 140 and the interior walls of the housing stem 191. Fuel is prevented from flowing through the stagnant air gap by virtue of the fluid-tight connections between the inner and outer fuel tubes and inlet fitting 162, and the second end is of the inner and outer fuel tubes and tip adapter 182. The stagnant air gap is closed at the fitting end, and can be likewise closed at the nozzle end, or can have a vent port 212 leading to the outer air swirler 204, if necessary or desirable.

The techniques for assembling the fuel injector of FIGS. 5 and 6 are similar as with the fuel injector of FIGS. 1–3. Fuel conduit 140 is initially assembled with housing 162, with inner tube 160 brazed at its upper end to retainer 166, which is itself brazed to housing 162, and outer tube 161 brazed at its upper end to housing 162. The fuel conduit is then inserted into housing stem 191, which seals at its upper end within the lower portion 197 of housing 162. The lower end of inner tube 160 and the lower end of outer tube 161 are then brazed to the tip adapter 182. The nozzle tip 163 is then torqued in place against tip adapter 182 via threads between the lower angled portion 198 of the housing stem 191 and the outer air swirler assembly.

Thus, as described above, the assembly of the internally heatshielded nozzle is fairly straight-forward and can be accomplished using only a few assembly steps with common assembly techniques, such as die-casting, drilling, brazing and welding. There are no complicated internal components, which thereby reduces the material cost of the fuel injector.

Moreover, the connection of the fuel conduit to the fitting in the nozzle provides a reliable fluid-tight seal over an extended cycle life of the engine. The coiled tube allows thermal expansion of a fuel conduit without significant stress being applied to the fuel conduit attachment locations. The stagnant air gap between the fuel conduit and the housing stem maintains the temperature within the fuel conduit within acceptable ranges to prevent coking in the fuel injector and maintain proper flow of fuel for efficient engine operation.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A fuel injector for a gas turbine engine, the fuel injector comprising:

a fitting having a first fuel passage for receiving fuel;

a nozzle having a second fuel passage for dispensing fuel;

a housing stem extending between and interconnecting said fitting and said nozzle for i) supporting said fuel nozzle, and ii) directing fuel flow from said fitting to said nozzle, said housing stem having an internal bore defined by internal walls extending longitudinally through the stem; and a fuel conduit disposed in the bore in said housing stem and closely surrounded by the internal walls of said housing stem, said fluid conduit having a first fixed connection with the fitting and a second fixed connection with the nozzle to fluidly interconnect the fuel passage in said fitting with the fuel passage in said nozzle, said internal bore in the housing stem being fluidly closed at the first connection to prevent fuel flowing around the fuel conduit in the bore, said fuel conduit having a coiled portion between said first and second connections to allow for thermal expansion of the fuel conduit within the bore, and said fuel conduit being spaced apart from the internal walls of the housing stem such that a stagnant air gap surrounds the fuel conduit along substantially the entire length of the fuel conduit between the fuel conduit and the housing stem.

2. The fuel injector as in claim 1, wherein said housing stem includes a flange extending outwardly away from said stem, said flange having an attachment device to allow said stem to be attached to the gas turbine engine.

3. The fuel injector as in claim 1, wherein said stem includes an enlarged recess at an end of the bore proximate said fitting which receives the coiled portion of the fuel conduit.

4. The fuel injector as in claim 3, wherein said fitting also includes an enlarged recess which receives the coiled portion of the fuel conduit, said recess of said fitting and said recess of said housing stem cooperating to form a cavity to enclose the coiled portion of the fuel conduit.

5. The fuel injector as in claim 4, wherein the recess of said fitting opens outwardly from an outlet end of the fitting and the recess of said housing stem opens outwardly from an inlet end of the stem, the inlet end of the housing stem and the outlet end of the fitting being welded together.

6. The fuel injector as in claim 1, wherein said housing stem is formed integrally with said nozzle.

7. The fuel injector as in claim 1, wherein said first connection between said fuel conduit and said fitting is a permanent, fluid-tight connection which prevents fuel in the fuel conduit from entering the stagnant air gap in the housing stem.

8. The fuel injector as in claim 7, wherein said second connection between said fuel conduit and said nozzle is a permanent, fluid-tight connection which prevents fuel in the fuel conduit from entering the stagnant air gap in the housing stem.

9. The fuel injector as in claim 1, wherein said nozzle includes an air passage, separate from said fuel passage, and the bore in the housing stem is fluidly connected to the air passage in the nozzle.

10. The fuel injector as in claim 1, wherein said fitting, housing stem and nozzle are rigidly and fixedly connected together.

11. The fuel injector as in claim 1, wherein said internal walls of the bore closely surround said fuel conduit.

12. The fuel injector as in claim 1, wherein said fuel conduit includes a pair of concentric fuel tubes, where an inner of the tubes defines a first fuel conduit passage from the fitting to the nozzle, and an outer of the fuel tubes defines a second fuel conduit passage from the fitting to the nozzle.

13. The fuel injector as in claim 12, wherein each of said fuel tubes includes a first end permanently sealed to the fitting, and a second end permanently sealed to the nozzle.

14. A fuel injector for a gas turbine engine having a combustor casing with an opening, the fuel injector comprising:

a fitting having a first fuel passage for receiving fuel, said fitting designed to be located exterior to the combustor casing;

a nozzle having a second fuel passage for dispensing fuel, said nozzle designed to be located within the combustor casing;

a housing stem extending through the opening in the combustor casing and between and interconnecting said fitting and said nozzle for i) supporting said fuel nozzle in the combustor casing, and ii) directing fuel flow from said fitting to said nozzle, said housing stem having an internal bore defined by internal walls extending through the stem; and a fuel conduit disposed in the bore in said housing stem and having a first permanent, fluidly-sealed connection with the fitting and a second permanent, fluidly-sealed connection with the nozzle to fluidly interconnect the fuel passage in said fitting with the fuel passage in said nozzle, said internal bore in the housing stem being fluidly closed at the first connection to prevent fuel flowing around the fuel conduit in the bore, said fuel conduit having a structure between said first and second connections to allow for thermal expansion of the fuel conduit within the bore and said fuel conduit being spaced apart from the internal walls of the housing stem, such that a stagnant air gap surrounds said fuel conduit along substantially the entire length of the fuel conduit between the fuel conduit and the housing stem.

15. The fuel injector as in claim 14, wherein said fuel conduit includes a coiled portion, and said housing stem includes an internal cavity for receiving said coiled portion of the fuel conduit, said coiled portion of the fuel conduit being supported within said internal cavity exterior to the combustor casing.

16. The fuel injector as in claim 14, wherein said fitting, housing stem and nozzle are rigidly and fixedly connected together as a single component which can be inserted into and located within the opening in the combustor casing.

17. The fuel injector as in claim 14, wherein said internal walls of said housing stem closely surround said fuel conduit.

18. The fuel injector as in claim 14, wherein said fuel conduit includes a pair of fuel tubes, where a first of the fuel tubes has one end permanently fluidly sealed to the fitting and another end permanently fluidly sealed to the nozzle and defining a first fuel conduit passage from the fuel passage in the fitting to the fuel passage in the nozzle, and a second of the fuel tubes surrounds the first of the fuel tubes and has one end also permanently fluidly sealed to the fitting and another end permanently fluidly sealed to the nozzle and defining a second fuel conduit passage from the fuel passage in the fitting to the fuel passage in the nozzle.

19. The fuel injector as in claim 14, wherein said fuel conduit has a structure which includes a convoluted portion between said first connection and said second connection, said convoluted portion allowing thermal expansion of the fuel conduit within the bore.

20. A fuel injection assembly for a gas turbine engine, comprising:

a combustor casing with an opening, and a fuel injector, said fuel injector including:

a) a fitting having a first fuel passage for receiving fuel, said fitting located exterior to the combustor casing;

b) a nozzle having a second fuel passage for dispensing fuel, said nozzle located within the combustor casing;

c) a housing stem extending through the opening in the combustor casing and between and interconnecting said fitting and said nozzle for i) supporting said fuel nozzle in the combustor casing, and ii) directing fuel flow from said fitting to said nozzle, said housing stem having an internal bore defined by internal walls extending through the stem; and a fuel conduit disposed in the bore in said housing stem and having a first permanent, fluid-tight connection with the fitting and a second permanent fluid-tight connection with the nozzle to fluidly interconnect the fuel passage in said fitting with the fuel passage in said nozzle, said internal bore in the housing stem being fluidly closed at the first connection to prevent fuel flowing around the fuel conduit in the bore, said fuel conduit having a coiled portion between said first and second connections to allow for thermal expansion of the fuel conduit within the cavity and said fuel conduit being spaced apart from the internal walls of the housing stem, such that a stagnant air gap surrounds said fuel conduit along substantially the entire length of the fuel conduit between the fuel conduit and the housing stem.

21. The fuel injection assembly as in claim 20, wherein said housing stem includes a flange attached to an exterior wall surface of the combustor casing.

22. The fuel injection assembly as in claim 20, wherein the coiled portion of the fuel conduit is disposed exterior of the combustor casing.

23. The fuel injection assembly as in claim 20, wherein said fitting, housing stem and nozzle are rigidly and fixedly connected together as a single component which can be inserted into the opening in the combustor casing.

24. The fuel injection assembly as in claim 21, wherein said housing stem provides the primary support for the nozzle in the combustor casing.

25. The fuel injection assembly as in claim 20, wherein said internal walls of said housing stem closely surround said fuel conduit.

26. The fuel injection assembly as in claim 20, wherein said fuel conduit includes a pair of fuel tubes, where a first of the fuel tubes has one end permanently fluidly sealed to the fitting and another end permanently fluidly sealed to the nozzle and defining a first fuel conduit passage from the fuel passage in the fitting to the fuel passage in the nozzle, and a second of the fuel tubes surrounds the first of the fuel tubes and has one end also permanently fluidly sealed to the fitting and another end permanently fluidly sealed to the nozzle and defining a second fuel conduit passage from the fuel passage in the fitting to the fuel passage in the nozzle.

* * * * *